US010261468B2

(12) United States Patent
Kuroda et al.

(10) Patent No.: US 10,261,468 B2
(45) Date of Patent: Apr. 16, 2019

(54) IMAGE FORMING APPARATUS INCLUDING AN AIR DISCHARGE DUCT

(71) Applicant: FUJI XEROX CO., LTD., Tokyo (JP)

(72) Inventors: Yoshitaka Kuroda, Yokohama (JP); Fuyuki Kokubu, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/473,951

(22) Filed: Mar. 30, 2017

(65) Prior Publication Data

US 2018/0059585 A1 Mar. 1, 2018

(30) Foreign Application Priority Data

Aug. 26, 2016 (JP) ..... 2016-165347
Sep. 28, 2016 (JP) ..... 2016-189916

(51) Int. Cl.
*G03G 21/00* (2006.01)
*G03G 15/20* (2006.01)
*G03G 21/20* (2006.01)

(52) U.S. Cl.
CPC ..... *G03G 21/206* (2013.01); *G03G 15/2017* (2013.01); *G03G 2221/1645* (2013.01)

(58) Field of Classification Search
CPC ..... G03G 21/206; G03G 2221/1645; G03G 15/2017
USPC ..... 399/92, 93
See application file for complete search history.

(56) References Cited

U.S. PATENT DOCUMENTS 7,313,342 B2 * 12/2007 Katayama ..... G03G 15/0258 399/93
8,014,695 B2 * 9/2011 Watanabe ..... G03G 21/206 399/33
8,831,463 B2 * 9/2014 Kondo ..... G03G 21/206 399/91
9,052,690 B2 * 6/2015 Udagawa ..... G03G 21/206
9,141,080 B2 * 9/2015 Mitorida ..... G03G 21/206
9,658,580 B2 * 5/2017 Saito ..... G03G 21/206
2013/0108308 A1 * 5/2013 Kondo ..... G03G 15/2017 399/92
2014/0341607 A1 * 11/2014 Nakano ..... G03G 15/2017 399/92

FOREIGN PATENT DOCUMENTS

JP 2006163249 A * 6/2006
JP 2007286163 A * 11/2007
(Continued)

*Primary Examiner* — Robert B Beatty
(74) *Attorney, Agent, or Firm* — Sughrue Mion, PLLC

(57) ABSTRACT

An image forming apparatus includes: a fixing unit that fixes an unfixed image held by a recording medium by heating the recording medium; a first air discharge unit that is disposed at one end in a direction that cross a recording medium feeding direction of the fixing unit and discharges air around the fixing unit to an outside; a second air discharge unit that is disposed on a downstream side of the fixing unit in the recording medium feeding direction and discharges air around the second air discharge unit to an outside; and an air discharge duct member that causes discharge air of the first air discharge unit and discharge air of the second air, discharge unit to merge together and guides resulting merged air to a discharge opening of a rear wall of an apparatus main body of the image forming apparatus.

9 Claims, 14 Drawing Sheets

(56) References Cited

FOREIGN PATENT DOCUMENTS

| | | | | | |
|---|---|---|---|---|---|
| JP | 2007322470 | A | * | 12/2007 | ..... G03G 15/6573 |
| JP | 2010-276904 | A | | 12/2010 | |
| JP | 2011-180341 | A | | 9/2011 | |
| JP | 2012-68488 | A | | 4/2012 | |
| JP | 2015138081 | A | * | 7/2015 | |

* cited by examiner

IMAGE FORMING APPARATUS INCLUDING AN AIR DISCHARGE DUCT

CROSS-REFERENCE TO RELATED APPLICATIONS

This application is based on and claims priority under 35 USC 119 from Japanese Patent Application No. 2016-165347 filed on Aug. 26, 2016 and Japanese Patent Application No. 2016-189916 filed on Sep. 28, 2016.

SUMMARY

According to an aspect of the invention, there is provided an image forming apparatus comprising: a fixing unit that fixes an unfixed image held by a recording medium by heating the recording medium; a first air discharge unit that is disposed at one end in a direction that cross a recording medium feeding direction of the fixing unit and discharges air around the fixing unit to the outside; a second air discharge unit that is disposed on the downstream side of the fixing unit in the recording medium feeding direction and discharges air around the second air discharge unit to the outside; and an air discharge duct member that causes discharge air of the first air discharge unit and discharge air of the second air discharge unit to merge together and guides resulting merged air to a discharge opening of a rear wall of an apparatus main body.

BRIEF DESCRIPTION OF THE DRAWINGS

Exemplary embodiments of the present invention will be described in detail based on the following figures, wherein.

DETAILED DESCRIPTION

Exemplary embodiments of the present invention will be hereinafter described with reference to the drawings.

[Exemplary Embodiment 1]

Figure 1:
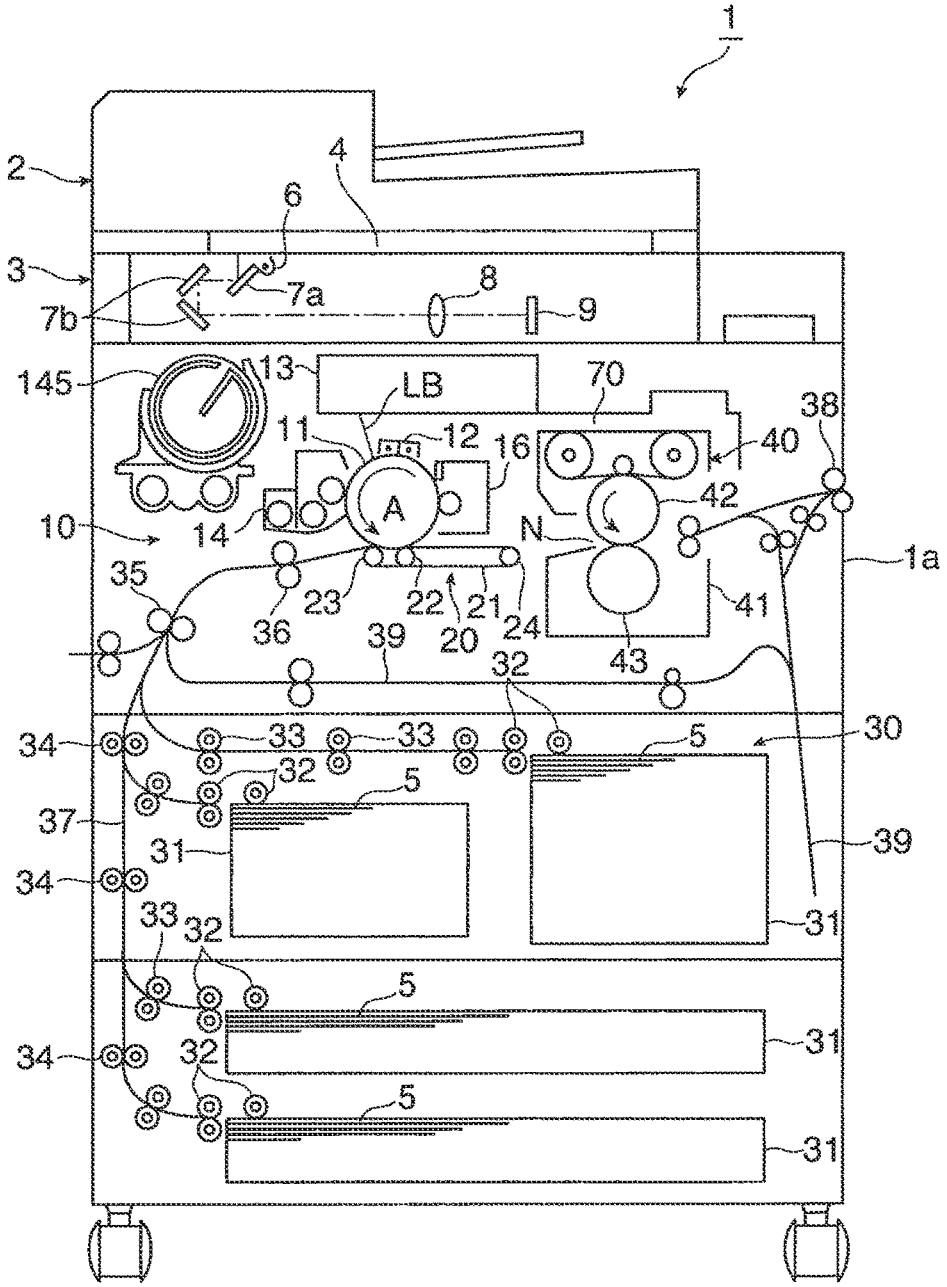
FIG. 1 shows a general configuration of an image forming apparatus according to a first exemplary embodiment of the present invention.
Figure 2:
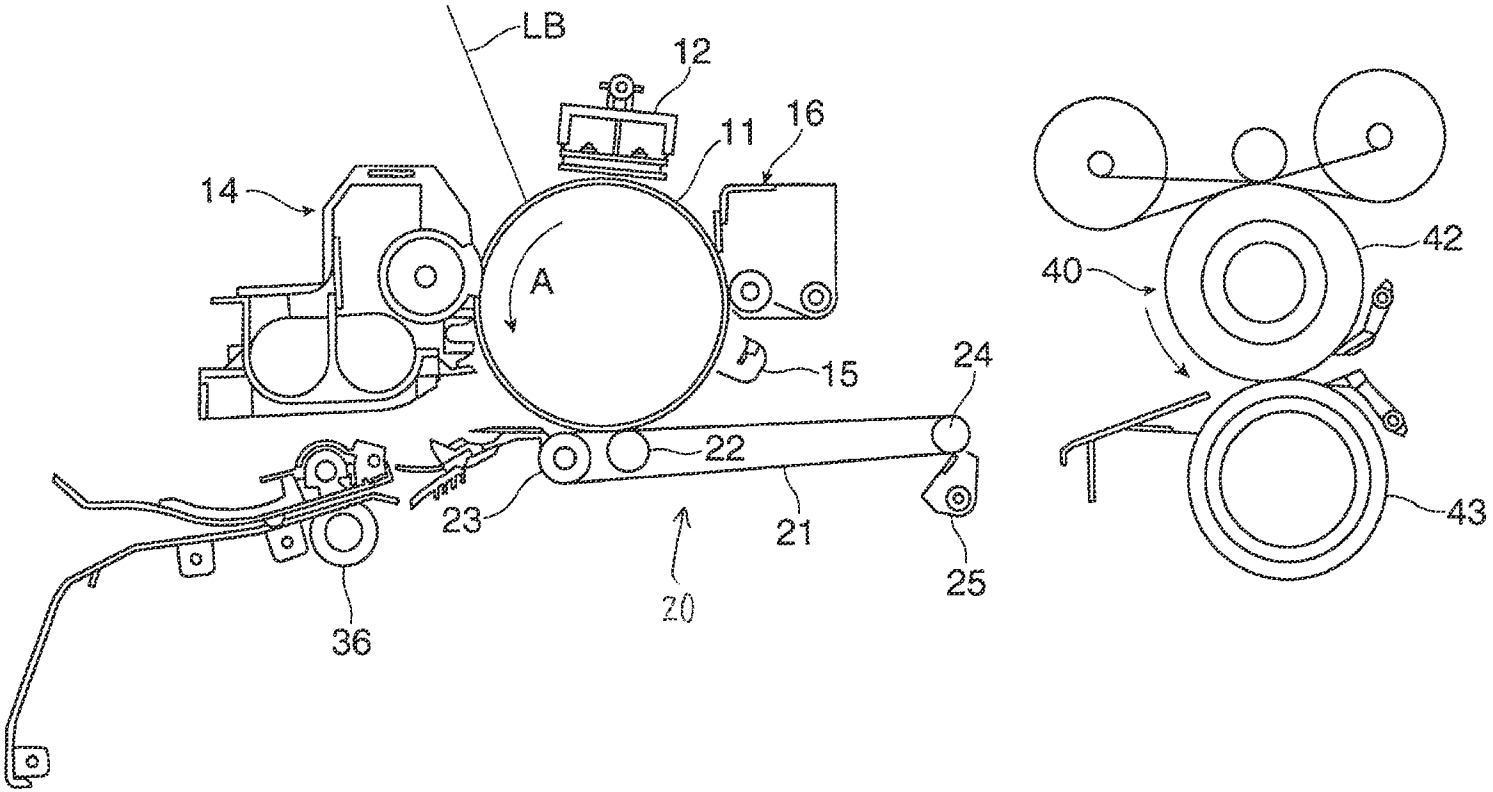
FIG. 2 shows the configuration of an image forming device etc. of the image forming apparatus according to the first exemplary embodiment.

FIGS. 1 and 2 show an image forming apparatus according to a first exemplary embodiment. FIG. 1 outlines the entire image forming apparatus 1, and FIG. 2 shows, in enlarged form, essential parts (image forming device etc.) of the image forming apparatus 1.

<Overall Configuration of Image Forming Apparatus 1>

The image forming apparatus 1 according to the first exemplary embodiment is a monochrome image forming apparatus which employs electrophotography. The image forming apparatus 1 equipped with, over an apparatus main body 1*a*, an automatic document feeder 2 for feeding a document (not shown) to a reading position automatically and an image reading device 3 for reading an image of the document on a document placement glass plate 4.

The image reading device 3 is configured so as to read an image of a document (not shown) by illuminating, with a light source, the document being fed so as to pass a reading position on the document placement glass plate 4 by the automatic document feeder 2 or resting on the document placement glass plate 4 and forming an optical image of light reflected from the document and received via a full-rate mirror 7*a* and a half-rate mirror 7*b* on an image reading device 9 by an image forming lens 8.

The image forming apparatus 1 is equipped with an image forming device 10 which is an example toner image forming unit for forming a toner image by development using toner (developer), a transfer device 20 for transferring the toner image formed by the image forming device 10 on a recoding sheet 5 which is an example recording medium, a sheet supply device 30 which houses and conveys prescribed recording sheets 5 to be supplied to a transfer position of the transfer device 20, a fixing device 40 for fixing a toner image transferred onto the recording sheet 5 by the transfer device 20, and other devices.

As shown in FIG. 1, the image forming device 10 is equipped with a rotary photoreceptor drum 11 which is an example image holding body. Following devices as example devices of an image forming unit are mainly disposed around the photoreceptor drum 11. For example, these devices are a charging device 12 for charging a circumferential surface (image holding surface) capable of image formation of the photoreceptor drum 11 to a prescribed potential, an exposing device 13 which is an example electrostatic latent image forming unit for forming an electrostatic latent image having potential differences by illuminating a charged portion of the circumferential surface of the photoreceptor drum 11 with light LB that reflects image information (an image signal), a developing device 14 which is an example developing unit for producing a toner image by developing the electrostatic latent image with toner (developer), the transfer device 20 which is an example transfer unit for transferring the toner image onto a recording sheet 5, a pre-cleaning charging device 15 (see FIG. 2) for removing electricity from the circumferential surface of the photoreceptor drum 11 by giving prescribed charge to the circumferential surface before cleaning it, and a drum cleaning device 16 for cleaning the image holding surface of the photoreceptor drum 11 that has been subjected to the electricity removal of the pre-cleaning charging device 15 by removing substances such as toner remaining on (stuck to) the image holding surface.

The photoreceptor drum 11 is configured in such a manner that an image holding surface having a photoconductive layer (photosensitive layer) made of a photosensitive material is formed on the circumferential surface of a cylindrical hollow or solid base member which is grounded. The photoreceptor drum 11 is supported so as to be rotated in the direction indicated by arrow A receiving motive power from a drive device (not shown).

The charging device 12 is a non-contact charging device such as a scorotron which is disposed adjacent to (i.e., not in contact with) the surface of the photoreceptor drum 11. The charging device 12 is supplied with a charging voltage. Where the developing device 14 is of a reversal development type, the charging device 12 is supplied with a charging voltage or current having the same polarity as a charging polarity of toner that is supplied from the developing device 14. Alternatively, the charging device 12 may be a contact charging device having, for example, a contact charging roll disposed in contact with the photoreceptor drum 11.

The exposing device 13 is a device for forming an electrostatic latent image on that portion of the circumferential surface of the photoreceptor drum 11 which has been charged by illuminating it with light LB that reflects image information of a document (not shown) read by the image reading device 3 or image information that is input to the image forming apparatus 1. Upon arrival of a time to form an electrostatic latent image, image information (an image signal) produced by performing image processing in an image processing unit on image information of a document read by the image reading device 3 or image information that is input to the image forming apparatus 1 through a certain means.

The developing device 14 is configured in such a manner that a development roll which bears developer and carries it to a development region that is opposed to the photoreceptor drum 11, two stirring/transporting members such as screw augers for transporting developer so that it passes by the development roll while stirring it, a layer thickness restricting member for restricting the amount (layer thickness) of developer born by the development roll, etc. are arranged inside a body that is formed with an opening and a developer housing room. A development bias is supplied between the development roll of the developing device 14 and the photoreceptor drum 11 from a power source device (not shown). A two-component developer containing a non-magnetic toner and a magnetic toner is used as the developer.

The non-magnetic toner to be used in the developing device 14 maybe of any of various kinds. For example, an EA toner containing a release agent such as wax is used as the toner, to reduce energy consumption and increase productivity. Such components as wax of the toner easily vaporize when subjected to fixing treatment which includes heating by the fixing device 40, as a result of which the air around the fixing device 40 may contain vaporized components as wax at a relatively large percentage.

As shown in FIG. 2, the transfer device 20 is a contact transfer device which is equipped with a transfer roll 22 which is supplied with a transfer voltage and rotated being in contact with the circumferential surface of the photoreceptor drum 11 via a transfer belt 21. A DC voltage that is opposite in polarity to the toner charging polarity is supplied as the transfer voltage from the power source device (not shown).

The transfer device 20 is mainly composed of the transfer belt 21 which is rotated so as to pass a transfer position located between the photoreceptor drum 11 and the transfer roll 22, plural belt support rolls 23 and 24 which support the transfer belt 21 rotatably from inside so that it is kept in a desired state, the transfer roll 22 as an example transfer unit which is disposed on the side of the inner surface (back surface) of the transfer belt 21 and serves to transfer a toner image formed on the photoreceptor drum 11 to a recording sheet 5, and a belt cleaning device 25 for cleaning the outer surface of the transfer belt 21 by removing substances such as toner and paper powder remaining on (stuck to) that portion of the outer surface which has passed the transfer roll 22.

The transfer belt 21 is an endless belt made of a material in which a resistivity adjusting agent such as carbon black is dispersed in a synthetic resin such as a polyimide resin or a polyamide resin. The belt support roll 23 is a drive roll that is driven rotationally by a drive device (not shown), and the belt support roll 24 is a tension exerting roll for exerting tension to the transfer belt 21.

The pre-cleaning charging device 15 is a non-contact charging device such as a corotron which is disposed adjacent to (i.e., not in contact with) the surface of the photoreceptor drum 11. The pre-cleaning charging device 15 is supplied with a charging voltage. The pre-cleaning charging device 15 is supplied with a charging voltage or current that is opposite in polarity to the toner charging polarity.

The drum cleaning device 16 is composed of a container-shaped body having an opening, a cleaning brush which is disposed so as to be in contact with that portion of the circumferential surface of the photoreceptor drum 11 which has been subjected to transfer at a prescribed pressure and cleans that portion of the photoreceptor drum 11 by removing sticking substances such as residual toner, a cleaning plate which is disposed so as to be in contact with that portion of the circumferential surface of the photoreceptor drum 11 which has been subjected to transfer at a prescribed pressure and cleans that portion of the photoreceptor drum 11 by removing sticking substances such as residual toner, and a sending member such as a screw auger which collects substances such as toner that have been removed by the cleaning brush and the cleaning plate and sends them to a collection system (not shown).

As shown in FIG. 1, the fixing device 40 is configured in such a manner that a roll or belt-shaped heating rotary body 42 which is rotated in the direction indicated by an arrow and heated by a heating unit so that its surface temperature is kept at a prescribed value and a roll or belt-shaped pressing rotary body 43 which is rotated being in contact with the heating rotary body 42 at a prescribed pressure (their axes are approximately parallel with each other) are disposed inside a case 41 which is formed with an inlet and an outlet for a recording sheet 5. In the fixing device 40, the contact portion where the heating rotary body 42 and the pressing rotary body 43 are in contact with each other is a fixing treatment portion (nip portion) N for performing prescribed fixing treatment (heating and pressing). The configuration of the fixing device 40 will be described later in detail.

The sheet supply device 30 is disposed under the transfer device 20. The sheet supply device 30 is mainly composed of (a single or) plural sheet housing bodies 31 each of which houses a stack of recording sheets 5 of a desired size, kind, etc. and sending devices 32 each of which sends out recording sheets 5 one by one from the associated sheet housing body 31. For example, each sheet housing body 31 is attached so as to be able to be pulled out of the image forming apparatus 1 to its front side (i.e., the side from which a user is to face the image forming apparatus 1 in manipulating it) by means of guide rails (not shown).

For example, recording sheets 5 are thin sheets of paper such as plain paper sheets to be used for electrophotographic copiers, printers, etc. or tracing paper sheets, OHP sheets, or the like. To increase the smoothness of an image surface of a recording sheet 5 as subjected to fixing, it is preferable that the surfaces of the recording sheet 5 itself be as smooth as possible. In this regard, for example, what is called thick sheets that are relatively large in grammage such as coated paper sheets formed by coating the surfaces of plain paper sheets with resin or the like and art paper sheets for printing can be used.

As shown in FIG. 1, sets of sheet conveying roll pair (s) 33-36 for conveying, to the transfer position, a recording sheet 5 sent from the sheet supply device 30 and sheet conveyance passages 37 which are formed by conveyance guides are disposed between the sheet supply device 30 and the transfer device 20. A sheet conveying roll pair 36 which are disposed immediately before the transfer position in the sheet conveyance passages 37 are, for example, rolls (registration rolls) for adjusting the timing of supply of a recording sheet 5 to the transfer position. A sheet ejection roll pair 38 for ejecting a recording sheet 5 that has been subjected to fixing and is output from the fixing device 40 to an ejected sheets holding unit (not shown) that is attached to a side surface of the image forming apparatus 1 is disposed near a recording sheet ejection outlet of the apparatus main body 1*a*.

A conveyance passage 39 for double-sided image formation which allows a recording sheet 5 bearing an image on one surface to be flipped and conveyed to the transfer device 20 again and to be subjected to image formation on its other surface is disposed below the sheet ejection roll pair 38.

In FIG. 1, reference numeral 145 denotes a toner cartridge which is disposed perpendicularly to the paper surface of FIG. 1 and contains developer to be supplied to the developing device 14 and containing at least toner.

<Operation of Image Forming Apparatus 1>

A basic image forming operation of the image forming apparatus 1 will be described below.

Upon receiving command information that requests execution of a monochrome image forming operation (printing) from a user interface, a printer driver, or the like (not shown), the image forming device 10, the transfer device 20, the fixing device 40, etc. start to operate.

In the image forming device 10, as shown in FIG. 1, first, the photoreceptor drum 11 is rotated in the direction indicated by arrow A and the charging device 12 charges the surface of the photoreceptor drum 11 to a prescribed potential of a prescribed polarity (in the first exemplary embodiment, negative polarity). Then the exposing device 13 forms an electrostatic latent image having prescribed potential differences on the surface of the photoreceptor drum 11 by illuminating a charged portion of the surface of the photoreceptor drum 11 with light LB that is emitted on the basis of an image signal of a document (not shown) read by the image reading device 3 or an image signal that is input to the image forming apparatus 1.

Subsequently, the image forming device 10 performs development by supplying the electrostatic latent image formed on the photoreceptor drum 11 with toner that is charged with a prescribed polarity (negative polarity) from the development roll of the developing device 14 and thereby causing the toner to be stuck to the surface of the photoreceptor drum 11 electrostatically. As a result of the development, the electrostatic latent image formed on the photoreceptor drum 11 is visualized as a monochrome (black) toner image.

When the toner image formed on the photoreceptor drum 11 of the image forming device 10 reaches the transfer position, the transfer roll 22 of the transfer device 20 transfers the toner image to a recording sheet 5 being conveyed by the transfer belt 21 of the transfer device 20.

In the image forming device 10, after completion of the transfer, the pre-cleaning charging device 15 removes electricity from the surface of the photoreceptor drum 11 and then the drum cleaning device 16 cleans the surface of the photoreceptor drum 11 by removing sticking substances by scraping them off. As a result, the image forming device 10 is rendered in such a state as to be able to perform the next image forming operation.

On the other hand, the sheet supply device 30 sends out a prescribed recording sheet 5 to the sheet conveyance passages 37 with timing that is suitable for the image forming operation. In the sheet conveyance passages 37, the sheet conveying roll pair 36 (registration rolls) sends out (supplies) the recording sheet 5 to the transfer belt 21 of the transfer device 20 with the same timing as transfer timing.

At the transfer position, the transfer roll 22 of the transfer device 20 transfers the toner image on the photoreceptor drum 11 to the recording sheet 5 being conveyed by the transfer belt 21.

The recording sheet 5 to which the toner image has been transferred is conveyed to the fixing device 40 by the transfer belt 21. In the fixing device 40, the toner image is fixed to the recording sheet 5 by performing necessary fixing treatment (heating and pressing) by causing the transfer-completed recording sheet 5 to be introduced to and pass the nip portion N between the rotating heating rotary body 42 and pressing rotary body 43.

Finally, where the image forming operation is a single-sided one, the sheet ejection roll pair 38 ejects the fixing-completed recording sheet 5 to the ejected sheets holding unit (not shown) which is attached to the side surface of the image forming apparatus 1.

Where the image forming operation is a double-sided one, the recording sheet 5 bearing the image on one surface is not ejected to the ejected sheets holding unit (not shown) and, instead, is flipped as it goes through the conveyance passage 39 for double-sided image formation and then conveyed to the transfer device 20 again, where another toner image is transferred to its other surface. The recording sheet 5 bearing the toner image on the other surface is conveyed to the fixing device 40 by the transfer belt 21 and subjected to fixing treatment (heating and pressing) there. The recording sheet 5 is thereafter ejected by the sheet ejection roll pair 38 to the ejected sheets holding unit (not shown) which is attached to the side surface of the image forming apparatus 1.

Subjected to the above-described operation, the recording sheet 5 is output on which the monochrome image(s) is formed.

<Configuration of Fixing Device 40>

Figure 3:
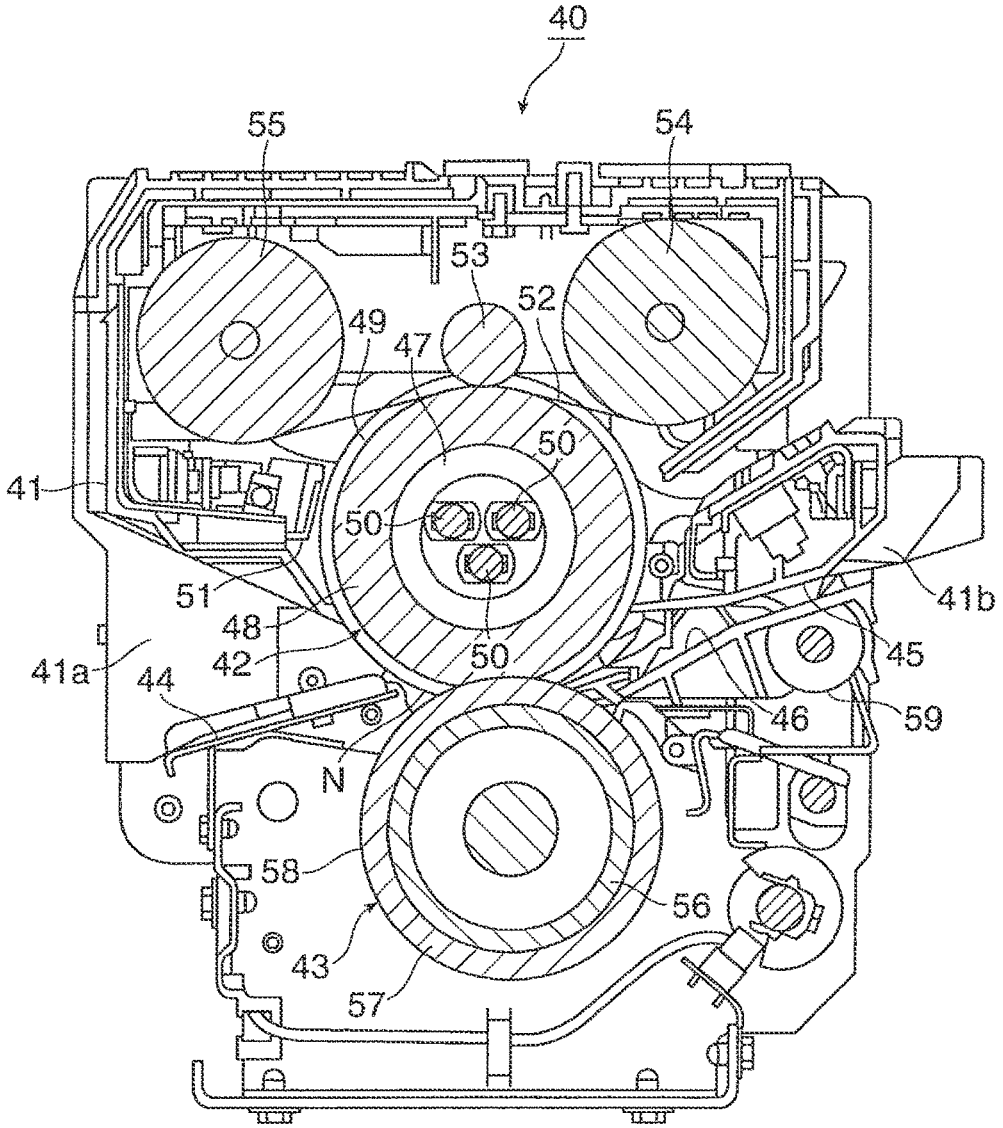
FIG. 3 is a sectional view showing the configuration of a fixing device.

FIG. 3 is a sectional view showing the configuration of the fixing device 40 employed in the image forming apparatus 1 according to the first exemplary embodiment.

As shown in FIG. 3, the fixing device 40 is equipped with the case 41 which is a box that is approximately shaped like a cuboid and is formed with an inlet 41*a* and an outlet 41*b* for a recording sheet 5. The inlet 41*a* of the case 41 is provided with a flat-plate-like inlet guide member 44 for guiding a recording sheet 5 that has been conveyed by and peeled off the transfer belt 21 to the nip portion N where the heating roll 42 and the pressing roll 43 are in pressure contact with each other. The outlet 41*b* of the case 41 is provided with a pair of outlet guide members 45 and 46 which are opposed to each other in the vertical direction so as to guide a recording sheet 5 that has been subjected to fixing treatment at the nip portion N.

The heating roll 42 as an example heating rotary body and the pressing roll 43 as an example pressing rotary body which are in pressure contact with each other to form the nip portion N are disposed inside the case 41 of the fixing device 40. The heating roll 42 and the pressing roll 43 are disposed in such a manner that switching can be made between a pressure contact state in which they are pressed against each other at a prescribed pressure and a separated state in which they are spaced from each other.

The heating roll 42 is composed of a cylindrical metal core 47 made of a metal such as stainless steel, an aluminum alloy, or the like, a relatively thick heat-resistant elastic layer 48 which is made of heat-resistant silicone rubber or the like and covers the surface of the metal core 47, and a release layer 49 which is made of tetrafluoroethylene, PFA, or the like and covers the surface of the heat-resistant elastic layer 48. Three halogen lamps 50 as a heat generation source are disposed inside the heating roll 42. While the heating roll 42 is heated by the halogen lamps 50 from inside, the energization of the halogen lamps 50 is controlled by a controller (not shown) with the surface temperature of the heating roll 42 detected by a temperature sensor 51 so that the surface temperature is kept at a prescribed fixing treatment temperature.

A cleaning web 52 which is made of nonwoven fabric or the like and serves to remove foreign substances such as toner stuck to the surface of the heating roll 42 is pressed against the surface of the heating roll 42 by a cleaning roll 53. The cleaning web 52 is supplied from a web supply roll 54 and taken up by a web take-up roll 55 with prescribed timing.

On the other hand, the pressing roll 43 is composed of a cylindrical metal core 56 which is a hollow cylinder with a central shaft or a solid cylinder and is made of a metal such as stainless steel, an aluminum alloy, or the like, a heat-resistant elastic layer 57 which is made of heat-resistant silicone rubber or the like, is thinner than the heat-resistant elastic layer 48 of the heating roll 42, and covers the surface of the metal core 56, and a release layer 58 which is made of tetrafluoroethylene, PFA, or the like and covers the surface of the heat-resistant elastic layer 57.

As shown in FIG. 3, an ejection roll pair 59 for ejecting, from the fixing device 40, a recording sheet 5 to which a toner image has been fixed during passage through the nip portion N where the heating roll 42 and the pressing roll 43 are in pressure contact with each other is disposed adjacent to the ejection outlet 41*b*.

<Configuration of Characterizing Part of Image Forming Apparatus 1>

Figure 4:
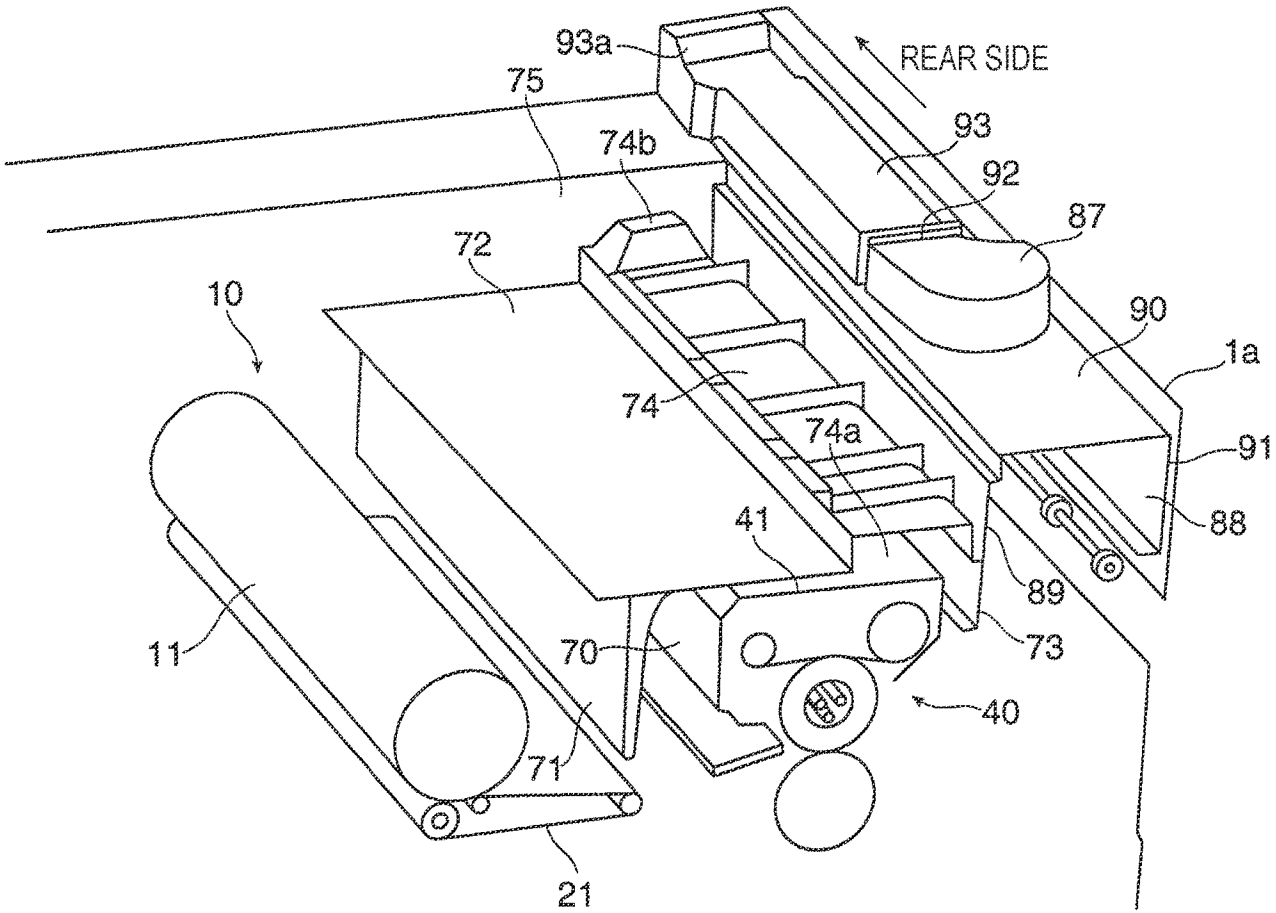
FIG. 4 is a perspective view showing the configuration of an essential part of the image forming apparatus according to the first exemplary embodiment.

As shown in FIG. 4, the image forming apparatus 1 according to the first exemplary embodiment is equipped with, around an upper portion of the fixing device 40, an air guide passage 70 for guiding the air around the fixing device 40 so that it is moved from the front side of the apparatus main body 1*a* to its rear side and discharges the air to the outside from the back side of the apparatus main body 1*a*. The air guide passage 70 is composed of a relatively thick, hollow partition wall 71 for heat insulation which is disposed on the upstream side of the fixing device 40 in the recording sheet feeding direction and separates the fixing device 40 and the image forming device 10, a first ceiling wall 72 which is disposed above the fixing device 40 so as to be opposed to the case 41 of the fixing device 40 with a prescribed gap and to extend from around the top end of the partition wall 71 downstream in the recording sheet feeding direction of the fixing device 40, and a hanging wall 73 which is disposed on the downstream side of the fixing device 40 in the recording sheet feeding direction so as to extend downward in the vertical direction from a position a little distant from the end of the first ceiling wall 72.

A first air discharge duct member 74 for guiding the air around the fixing device 40 to the rear side of the apparatus main body 1*a* is disposed on the downstream side of the fixing device 40 in the recording sheet feeding direction integrally with the first ceiling wall 72 of the air guide passage 70. The first air discharge duct member 74 is shaped like a rectangular cylinder that is fully opened at the bottom (bottom opening 74*a*) to the fixing device 40. The rear end of the air guide passage 70 is closed by a rear wall 75 excluding a portion corresponding to the first air discharge duct member 74. Although the first air discharge duct member 74 may be formed by a flat-plate-like member, to enhance heat insulation it is desirable that the first air discharge duct member 74 be formed by a laminated member of heat insulating material layers.

Figure 5:
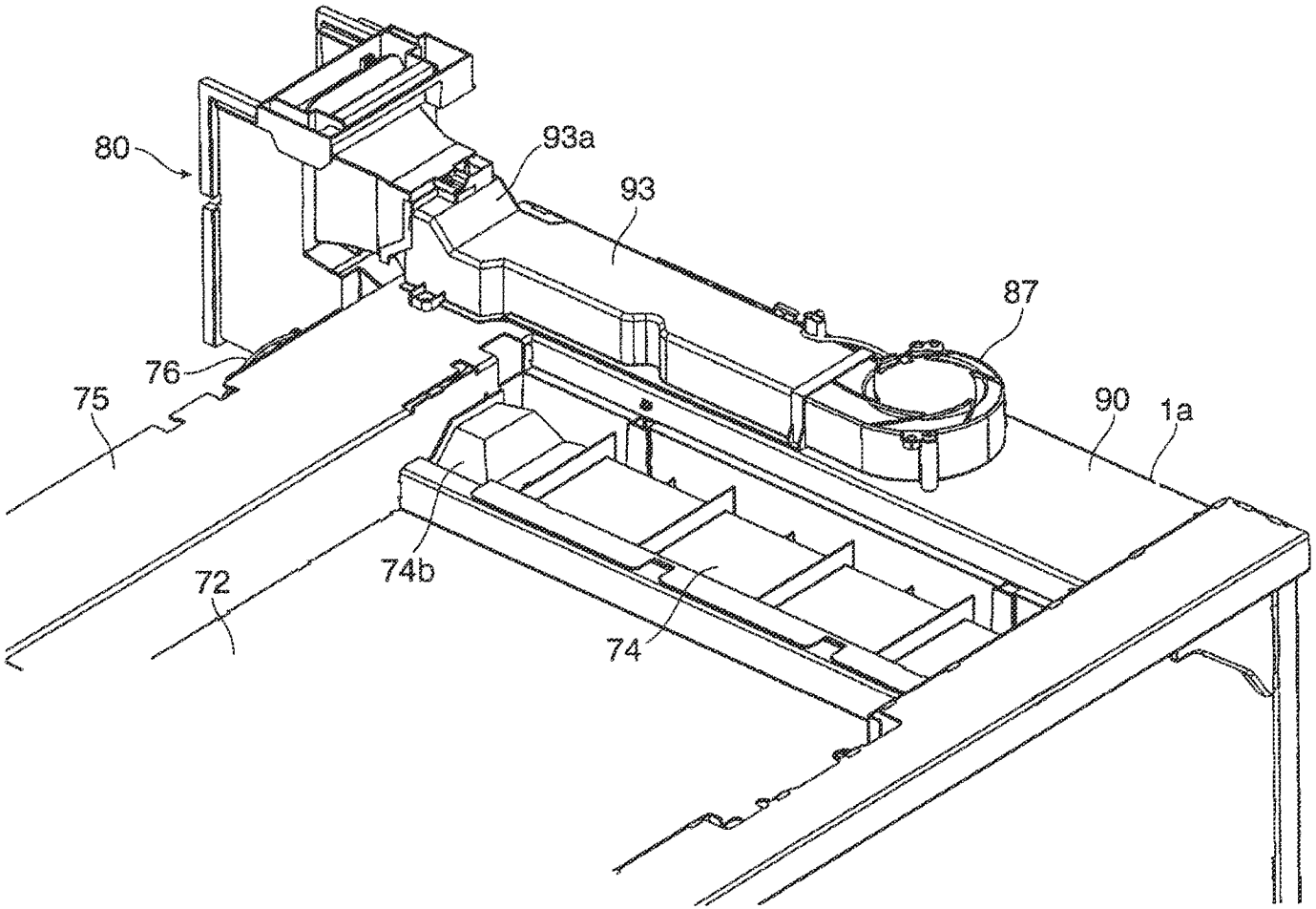
FIG. 5 is another perspective view showing the configuration of the essential part of the image forming apparatus according to the first exemplary embodiment.
Figure 6:
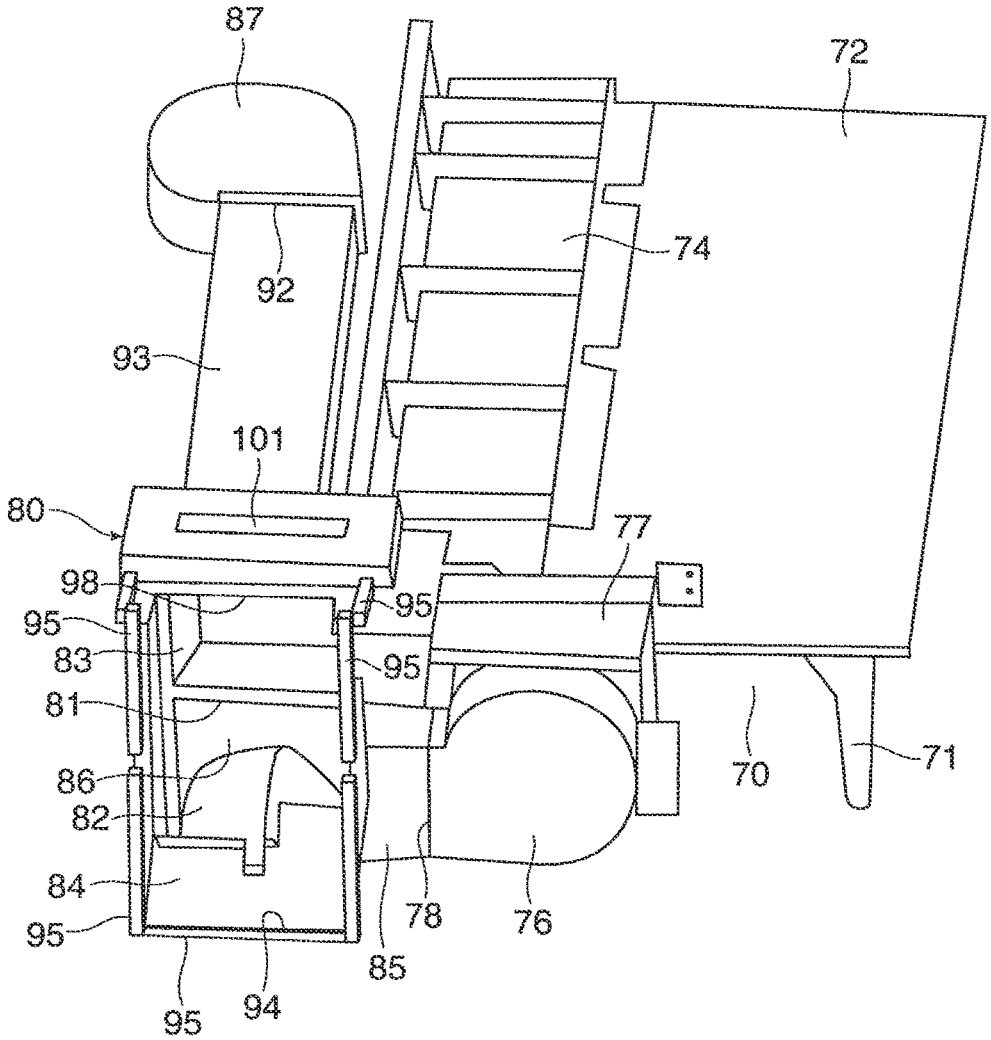
FIG. 6 is still another perspective view showing the configuration of the essential part of the image forming apparatus according to the first exemplary embodiment.

As shown in FIG. 4, the first air discharge duct member 74 is formed with, at the rear end, an expanded portion 74*b* which projects upward and serves to increase the sectional area there. As shown in FIGS. 5 and 6, a first air discharge fan 76 which is an example first air discharge unit for discharging the air around the fixing device 40 to the outside is disposed in the rear of the first air discharge duct member 74. The first air discharge fan 76 is a sirocco fan, for example.

As shown in FIG. 6, the first air discharge duct member 74 and the first air discharge fan 76 are connected to each other via a connection duct 77 which is a box that is approximately shaped like a cuboid. The expanded portion 74*b* of the first air discharge duct member 74 is connected to the front end of the connection duct 77. The first air discharge fan 76 is attached to the rear end, having an air suction opening (not shown), of the connection duct 77.

As shown in FIG. 6, a merging duct 80 is connected to an air discharge outlet 78 of the first air discharge fan 76. The merging duct 80 is a member for causing air discharged by the first air discharge fan 76 and air discharged by a second air discharge fan (described later) to merge together and discharging resulting air to the outside from the rear side of the apparatus main body 1*a*. The merging duct 80 is a box that is approximately shaped like a vertically long cuboid that is opened fully at its rear end located in the rear wall of the apparatus main body 1*a* and in which a portion, connected to the rear end, of its top wall is opened.

The inside space of the merging duct 80 is partitioned vertically by a flat-plate-like partition member 81 which extends from the front end of the merging duct 80 to a halfway position in the front-rear direction. A lower space 82, defined by the partition member 81, of the inside space of the merging duct 80 constitutes a first inflow space into which air discharged by the first air discharge fan 76 flows. On the other hand, an upper space 83 constitutes a second inflow space into which air discharged by the second air discharge fan flows. A vertically extending rear space 84 that extends vertically in the merging duct 80 without being partitioned by the partition member 81 constitutes a merging space where air discharged by the first air discharge fan 76 and air discharged by the second air discharge fan merge together.

Figure 7:
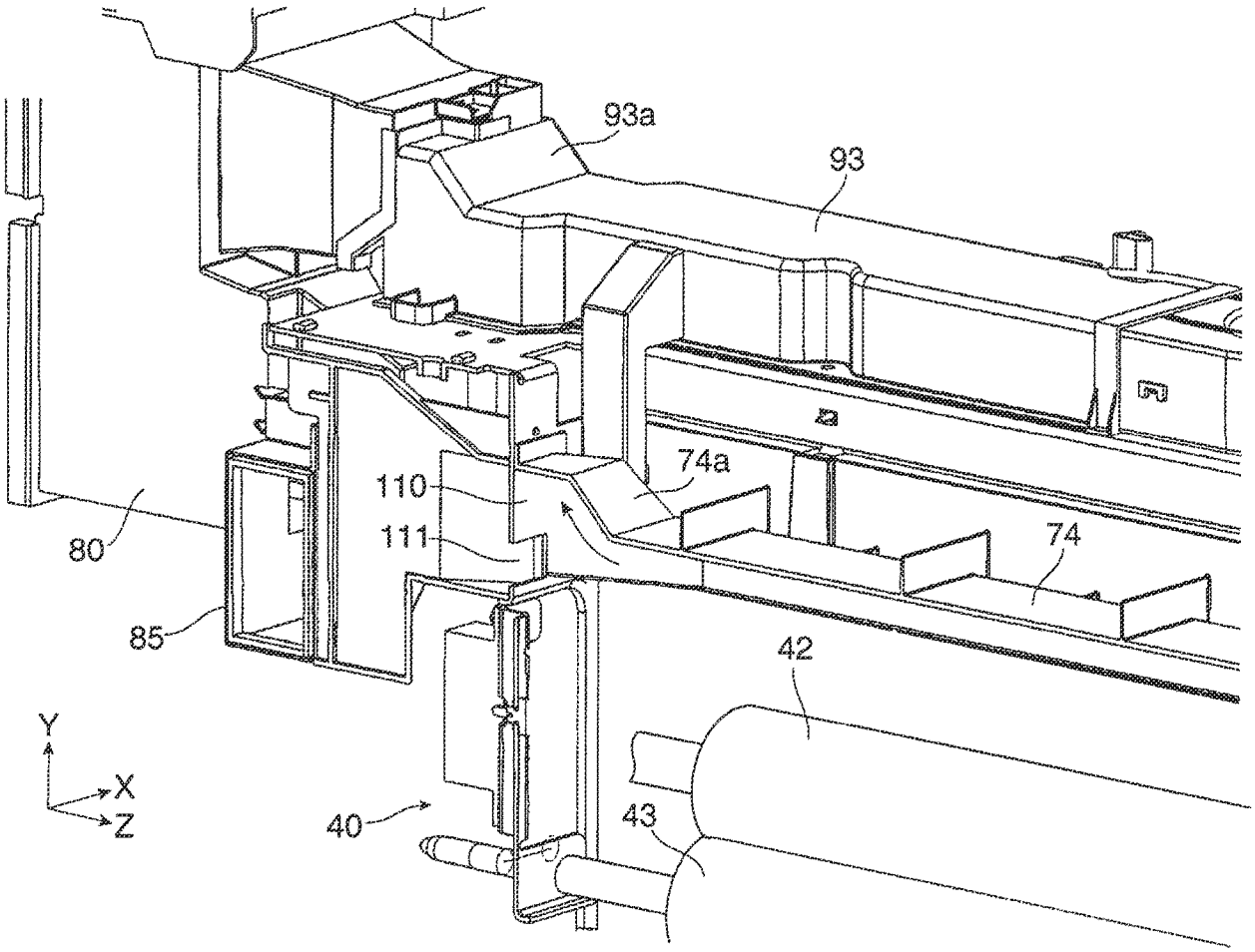
FIG. 7 is a further perspective view showing the configuration of the essential part of the image forming apparatus according to the first exemplary embodiment.
Figure 8:
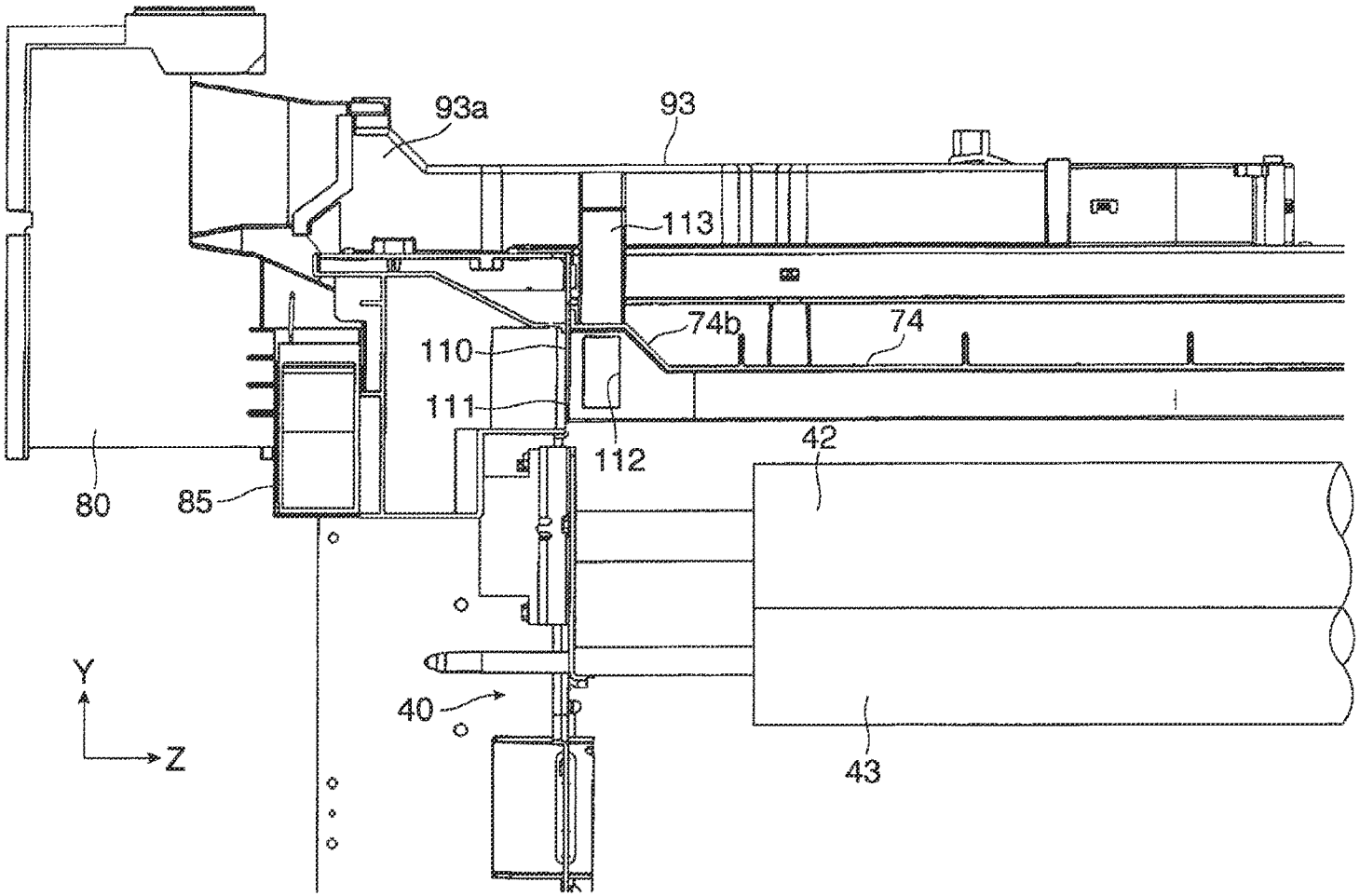
FIG. 8 is a sectional view showing the configuration of the essential part of the image forming apparatus according to the first exemplary embodiment.

As shown in FIGS. 7 and 8, one side wall of the merging duct 80 is provided with a first connection portion 85 which projects so as to be shaped like a rectangular cylinder and to which the air discharge outlet 78 of the first air discharge fan 76 is connected. The bottom wall of the first connection portion 85 is located below the bottom end of the first inflow space 82 (see FIG. 6). As shown in FIG. 6, the bottom wall of the first connection portion 85 is a slant wall so as to guide air that is discharged from the first air discharge fan 76 and introduced into the merging duct 80 to flow up obliquely in the merging duct 80. An inner side surface 86, opposed to the first connection portion 85, of the merging duct 80 is curved so as to redirect discharge air coming from the first air discharge fan 76 toward the rear wall of the apparatus main body 1*a*.

As shown in FIGS. 4 and 5, a second air discharge fan 87 which is a second air discharge unit for discharge air around it to the outside is disposed on the downstream side of the fixing device 40 in the recording sheet feeding direction. Like the first air discharge duct member 74, the second air discharge fan 87 is a sirocco fan, for example. A space 88 that is located on the downstream side of the fixing device 40 in the recording sheet feeding direction is surrounded by an upstream-side side wall 89 which extends from the hanging wall 73 of the air guide passage 70 upward in the vertical direction, a second ceiling wall 90 which is disposed so as to be higher than the first ceiling wall and to extend from the top end of the upstream-side side wall 89 toward the downstream side in the recording sheet feeding direction, and a downstream-side side wall 91 which hangs down in the vertical direction from the downstream-side end of the second ceiling wall 90.

As mentioned above, the second air discharge fan 87 is attached to the top surface of the second ceiling wall 90 at its center in the direction that crosses the recording sheet feeding direction. The second ceiling wall 90 is formed with an air suction opening (not shown) through which to discharge, to the outside, the air existing in the space 88 which is located on the downstream side of the fixing device 40 in the recording sheet feeding direction by sucking the air by the second air discharge fan 87. A second air discharge duct member 93 for guiding air discharged by the second air discharge fan 87 to the rear side of the apparatus main body 1*a* is connected to an air discharge opening 92 of the second air discharge fan 87.

The second air discharge duct member 93 is attached to the top surface of the second ceiling wall 90 so as to be directed to the rear wall of the apparatus main body 1*a*. The second air discharge duct member 93 is approximately shaped like a long and narrow rectangular cylinder. The second air discharge duct member 93 is formed with, at the rear end, an expanded portion 93*a* which projects upward and serves to increase the opening area. As shown in FIG. 6, the expanded portion 93*a* of the second air discharge duct member 93 is connected directly to the upper space 83, defined by the partition wall 81, of the merging duct 80.

As shown in FIG. 6, the rear end of the merging duct 80 is fully opened to form an air discharge opening 94 through which to discharge, through an opening of the rear wall of the apparatus main body 1*a*, discharge air of the first air discharge fan 76 and discharge air of the second air discharge fan 87 after they merge together in the merging duct 80. The air discharge opening 94 of the merging duct 80 is provided with sealing members 95 which are shaped like long and narrow rectangular cylinders and made of a synthetic resin foamed body (sponge) at its two side edges and bottom edge by, for example, bonding using a double-sided adhesive tape.

Figure 9:
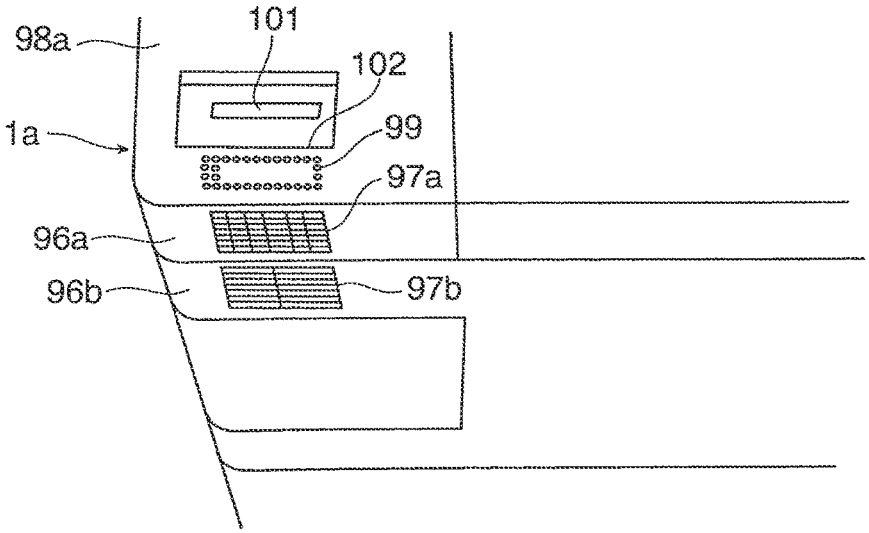
FIG. 9 is a perspective view showing the structure of a rear corner portion of an apparatus main body of the image forming apparatus.

As shown in FIG. 9, the air discharge opening 94 of the merging duct 80 is located adjacent to the rear wall of the apparatus main body 1*a* and covered with plural divisional back covers 96*a* and 96*b* of the apparatus main body 1*a*. The back covers 96*a* and 96*b* of the apparatus main body 1*a* are provided with plural respective louvers 97*a* and 97*b* which are example plural foreign substances entrance suppressing plates which suppress entrance of foreign manners by partially covering the air discharge opening 94 of the merging duct 80.

The top wall of the merging duct 80 is formed with an auxiliary air discharge opening 98 which is continuous with the air discharge opening 94. As shown in FIG. 9, the auxiliary air discharge opening 98 of the merging duct 80 is covered with a top cover 98*a* which is part of a top wall of the apparatus main body 1*a*. A large number of air discharge holes 99 for discharging, to the outside, air coming from the auxiliary air discharge opening 98 of the merging duct 80 are formed through the top cover 98*a* of the apparatus main body 1*a*.

Figure 10:
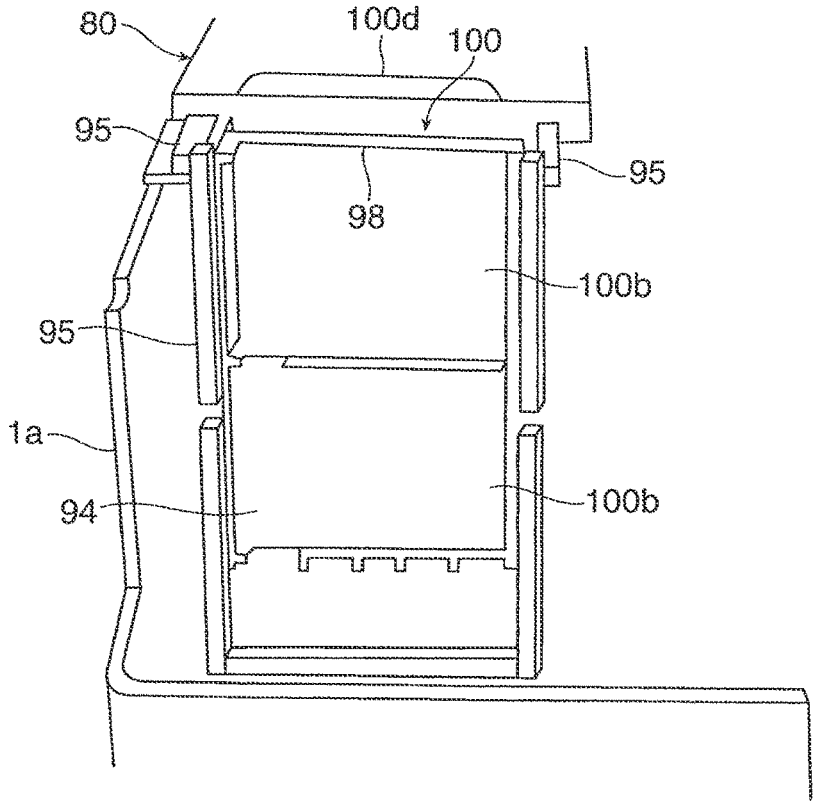
FIG. 10 shows a state that back covers and a top cover of the apparatus main body are removed from the apparatus main body.

As shown in FIG. 10, the merging duct 80 is provided with a filter member 100 for removing particular components from discharge air immediately in front of the merging space 84 where the first inflow space 82 and the second inflow space 83 merge together. FIG. 10 shows a state that the back covers 96*a* and 96*b* and the top cover 98*a* are removed from the apparatus main body 1*a*. As shown in FIG. 6, the top wall of the merging duct 80 is formed with an opening 101 through which to attach or detach the filter member 100.

Figure 11:
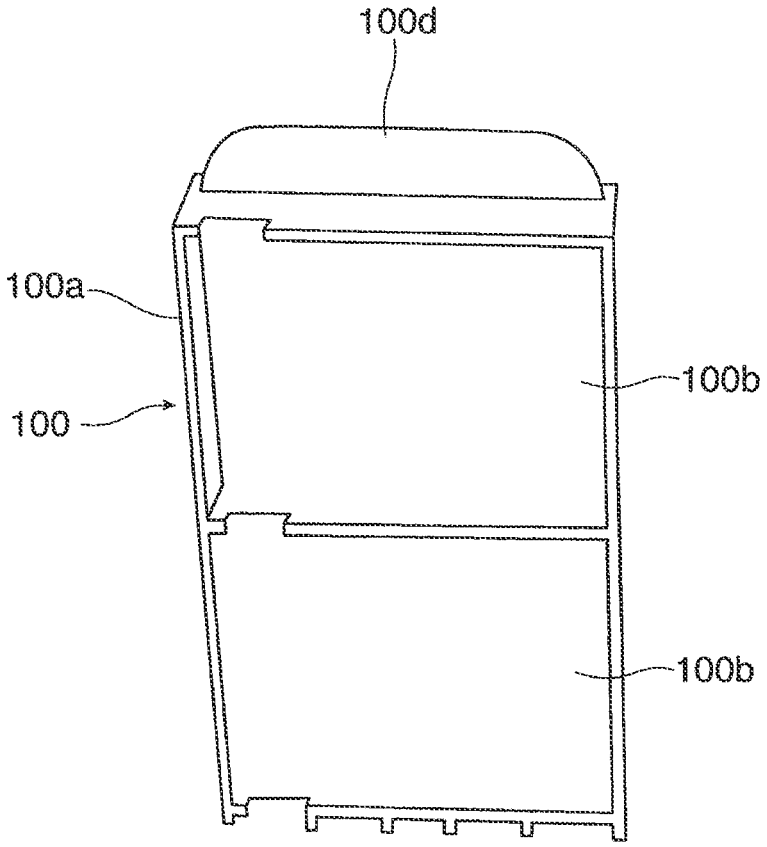
FIG. 11 is a perspective view showing the structure of a filter member.

As shown in FIG. 11, the filter member 100 is equipped with a frame body 100*a* which is made of a synthetic resin and shaped like a rectangle that conforms to a sectional shape of the merging duct 80 and filters 100*b* which are stretched so as to cover the opening of the frame body 100*a*. Each filter 100*b* is a thin film or sheet. Each filter 100*b* is basically made of, for example, a single or plural layers of nonwoven fabric. The base cloth of each filter 100*b* is itself capable of removing particles, ultrafine particles (UFPs), etc. contained in discharge air or is given as appropriate a chemical capable of removing particular components such as ultrafine particles and volatile organic compounds (VOCs) contained in discharge air by impregnation, coating, or the like. The top end of the filter member 100 is provided with a grip 100*d* for attachment/detachment of the filter member 100.

As shown in FIG. 9, the filter member 100 is attached to or detached from the merging duct 80 through the opening 101 of the merging duct 80 by gripping the grip 100*d* of the filter member 100 with a hand in a state that a lid for closing a manipulation opening 102 which is formed at a position corresponding to the filter member 100 being set in the merging duct 80 is removed.

Incidentally, in the exemplary embodiment, as shown in FIGS. 7 and 8, a shield plate 110 which is an example blown member over which discharge air of the first air discharge fan 76 is blown to have evaporated components of the air stick to it is disposed upstream of the first air discharge fan 76 in its air discharging direction. The shield plate 110 is disposed at the downstream end of the expanded portion 74*b* of the first air discharge duct member 74 in the air discharging direction. The shield plate 110 hangs down in the vertical direction from the ceiling of the expanded portion 74*b* of the first air discharge duct member 74 at the position where the expanded portion 74*b* is connected to the connection duct 77, in such a manner that the shield plate 110 closes at least part of the cross section (in the illustrated example, approximately ⅔ of the opening in the height direction) of the flow passage of air discharged by the first air discharge fan 76. Thus, a passage 111 having a reduced opening area is formed under the shield plate 110.

The shield plate 110's effect that evaporated components (e.g., was) of air that is discharged by the first air discharge fan 76 and blown over the shield plate 110 stick to it is enhanced as its area increases. However, if the area of the shield plate 110 were too large, the shield plate 110 would lower the air discharge efficiency unduly because of its resistance to air being discharged by the first air discharge fan 76. It is desirable that the height of the shield plate 110 be set approximately equal to ⅔ of the opening height at the position where the expanded portion 74*b* is connected to the connection duct 77. Furthermore, it is desirable that the shield plate 110 be disposed so as to hang down from the ceiling of the expanded portion 74*b* because air being discharged by the first air discharge fan 76 is redirected upward by the expanded portion 74*b* of the first air discharge duct member 74. Alternatively, the shield plate 110 may be disposed so as to extend upward from the bottom wall of the connection duct 77 and to form a narrow passage over the shield plate 110.

Figure 12:
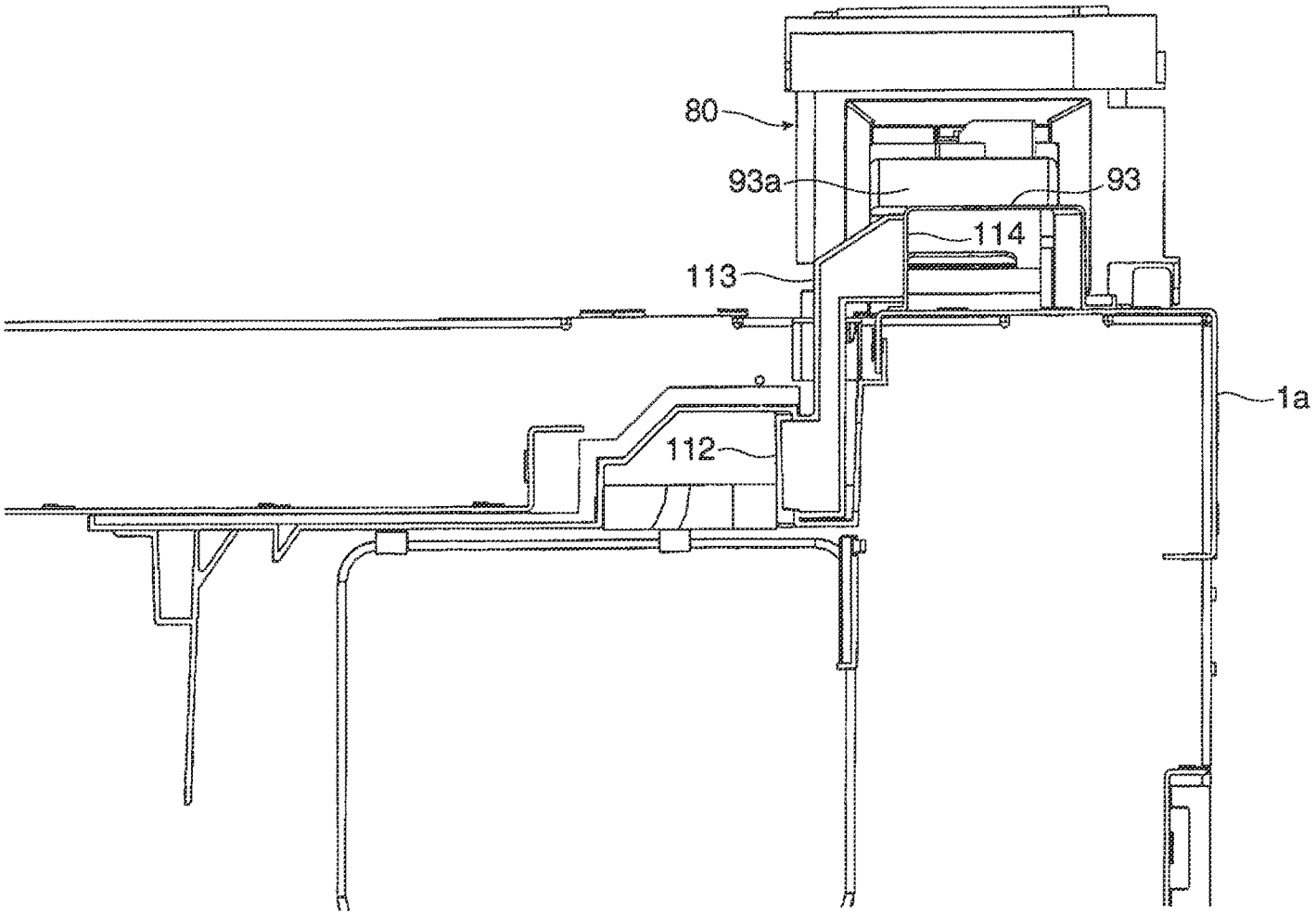
FIG. 12 is another sectional view showing the configuration of the essential part of the image forming apparatus according to the first exemplary embodiment.

In the exemplary embodiment, as shown in FIGS. 8 and 12, a cooling opening 112 which allows air that is lower in temperature than air being discharged by the first air discharge fan 76 to merge with the latter is formed in the first air discharge duct member 74 upstream of the shield plate 110 in the air discharge direction. The cooling opening 112 is a rectangular opening that is formed through a side wall of the expanded portion 74*b* of the first air discharge duct member 74. The cooling opening 112 may be formed so as to take in air existing just outside the first air discharge duct member 74. However, like air flowing through the first air discharge duct member 74, air existing just outside the first air discharge duct member 74 has been heated by heat generated by the fixing device 40 and thereby increased in temperature to some extent.

In view of the above, in the exemplary embodiment, to enable merging with air that is sufficiently lower in temperature than the air around the fixing device 40, the second air discharge duct member 93 is disposed on the downstream side of the fixing device in the recording sheet feeding direction. The base portion of an air feeding duct 113 for feeding air from the second air discharge duct member 93 to the cooling opening 112 is connected to an opening 114 which is formed in the second air discharge duct member 93 at a halfway portion. The tip end of the air feeding duct 113 is connected to the opening 112 of the first air discharge duct member 74.

<Workings of Characterizing Part of Image Forming Apparatus>

Figure 13:
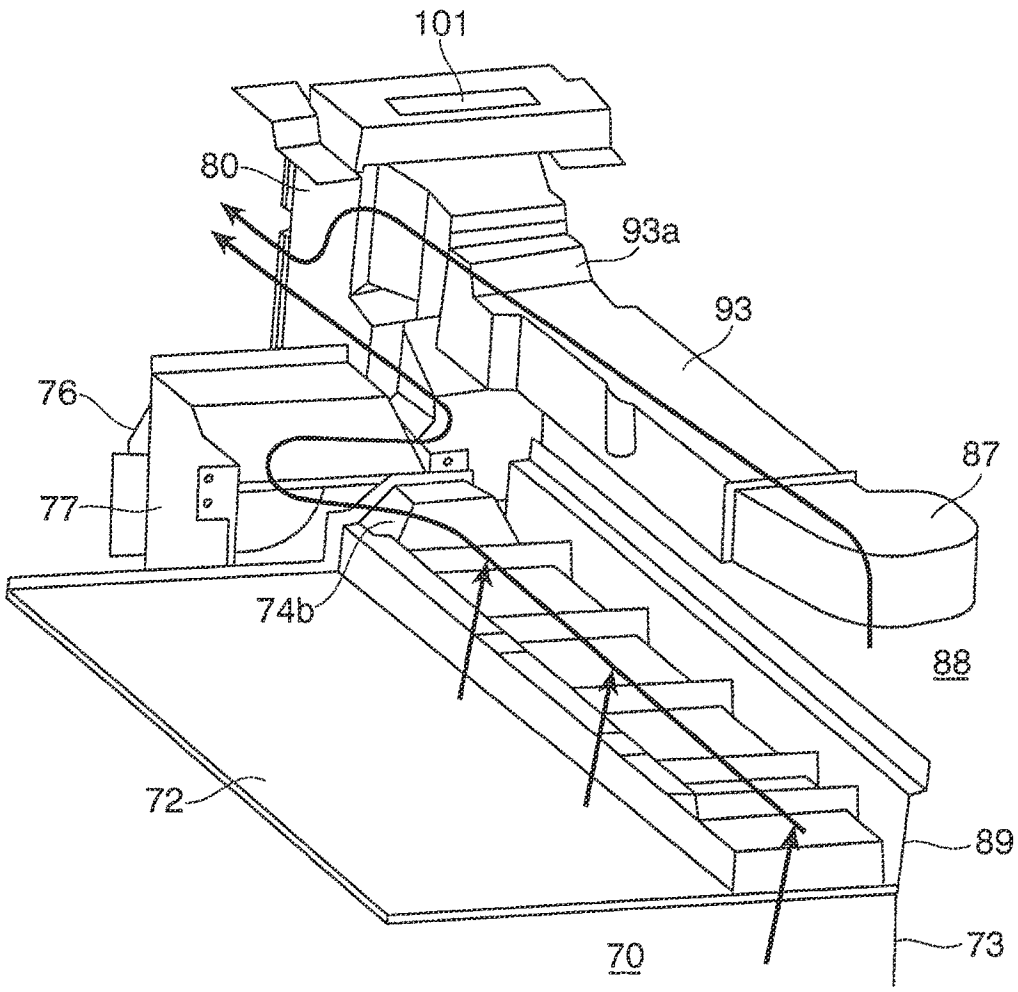
FIG. 13 is a perspective view illustrating workings of the image forming apparatus according to the first exemplary embodiment.

In the image forming apparatus 1 according to the exemplary embodiment, as shown in FIG. 13, driving of the first air discharge fan 76 and the second air discharge fan 87 is started at the same time as a start of an image forming operation. The first air discharge fan 76 sucks heated air from around the fixing device 40, that is, from the upstream side, in the recording sheet feeding direction, of the fixing device 40, the space over the fixing device 40, and the downstream side, in the recording sheet feeding direction, of the fixing device 40. The air that has been sucked by the first air discharge fan 76 via the connection duct 77 is sent to the inside of the merging duct 80.

The air that is sent to the inside of the merging duct 80 via the connection duct 77 contains wax etc. that are toner components that have evaporated from a toner image that was heated and fixed by the fixing device 40. Thus, unless a certain measure is taken, the evaporated components containing wax etc. that have evaporated from the toner image are sent to the first air discharge fan 76 directly. The evaporated components containing wax etc. hit the wind sending blades (not shown) of the first air discharge fan 76, are cooled and condensed, and stick to the wind sending blades, as a result of which non-uniformity occurs in blade rotational moment between regions where evaporated components containing wax etc. have stuck and regions where no or only small amount of evaporated components containing wax etc. have stuck. This may result in an event that the wind sending blades of the first air discharge fan 76 come to rotate non-uniformly to cause vibration as it ages or, in an extreme case, the wind sending blades are broken.

In the exemplary embodiment, as shown in FIGS. 7 and 8, the shield plate 110 is disposed upstream of the first air discharge fan 76 in the air discharge direction. Furthermore, air that is lower in temperature than the air around the fixing device 40 is sent to the opening 112 located upstream of the shield plate 110 in the air discharge direction via the part of the second air discharge duct member 93 and the air feeding duct 113.

The air that is lower in temperature than the air around the fixing device 40 and has been sent to the inside of the first air discharge duct member 74 through the opening 112 hits the shield plate 110 while lowering the temperature of air being discharged through the first air discharge duct member 74. Thus, when hitting the shield plate 110, air containing evaporated components containing wax etc. is cooled and condensed physically and the components containing wax etc. stick to the shield plate 110. As a result, after passing the shield plate 110, the air is introduced into the first air discharge fan 76 in a state that it contains no or only reduced amounts of evaporated components containing wax etc. In this manner, the event that evaporated components containing wax etc. stick to the air sending blades of the first air discharge fan 76 is prevented or suppressed.

On the other hand, air that is ejected from a recording sheet 5 that has passed the fixing device 40 is mainly sucked by the second air discharge fan 87 via the space 88 located downstream of the fixing device 40 in the recording sheet feeding direction. As shown in FIG. 13, the air that has been sucked by the second air discharge fan 87 is sent to the inside of the merging duct 80 via the second air discharge duct member 93.

As shown in FIGS. 6 and 10, such components as particles, untrafine particles (UPPs), and volatile organic compounds (VOCs) are removed (or reduced in amounts) from the air that has been introduced into the inside of the merging duct 80 by the filters 100*b* of the filter member 100. The resulting air merges with air coming from the first air discharge duct member 74 in the merging space 84 of the merging duct 80. More specifically, the air coming from the first air discharge duct member 74 and the air coming from the second air discharge duct member 93 merge together in the merging duct 80 as the former goes up and the latter goes down.

Thus, gases such as water vapor that have evaporated from a heated recording sheet 5 and are discharged from the second air discharge duct member 93 stick to such components as untrafine particles (UFPs) and volatile organic compounds (VOCs) that have been discharged from the first air discharge duct member 74 and have not been removed by the filter member 100, to increase their particle diameters. And such components as untrafine particles are recombined by heated air that is discharged from the first air discharge duct member 74. In this manner, the amount of untrafine particles etc. that are discharged to the outside from the air discharge opening 94 of the merging duct 80 is reduced very much.

As described above, according to the first exemplary embodiment, the amount of untrafine particles that are discharged to the outside from the fixing device 40 can be made smaller than in a case that an air intake duct is provided which is connected to an air discharge duct at a position upstream of a filter unit and serves to introduce air from outside an apparatus body.

In the first exemplary embodiment, as shown in FIGS. 6 and 10, the merging duct 80 is formed with the auxiliary air discharge opening 98 which is continuous with the top of the air discharge opening 94 of the merging duct 80. Thus, as shown in FIG. 9, air can be discharged through the auxiliary air discharge opening 98 even if the rear wall of the apparatus main body 1*a* is placed close to an obstructive body such as a wall (not shown).

In the first exemplary embodiment, a phenomenon that evaporated components in discharge air are condensed and deposited on the first air discharge fan 76 can be made less problematic than in a case that neither the shield plate 110 which is disposed upstream of the first air discharge fan 76 in its air discharging direction and over which discharge air of the first air discharge fan 76 is blown to have evaporated components in the discharge air stick to it nor the opening 112 which is formed upstream of the shield plate 110 and allows air that is lower in temperature than air being discharged by the first air discharge fan 76 to merge with the latter is provided.

[Exemplary Embodiment 2]

Figure 14:
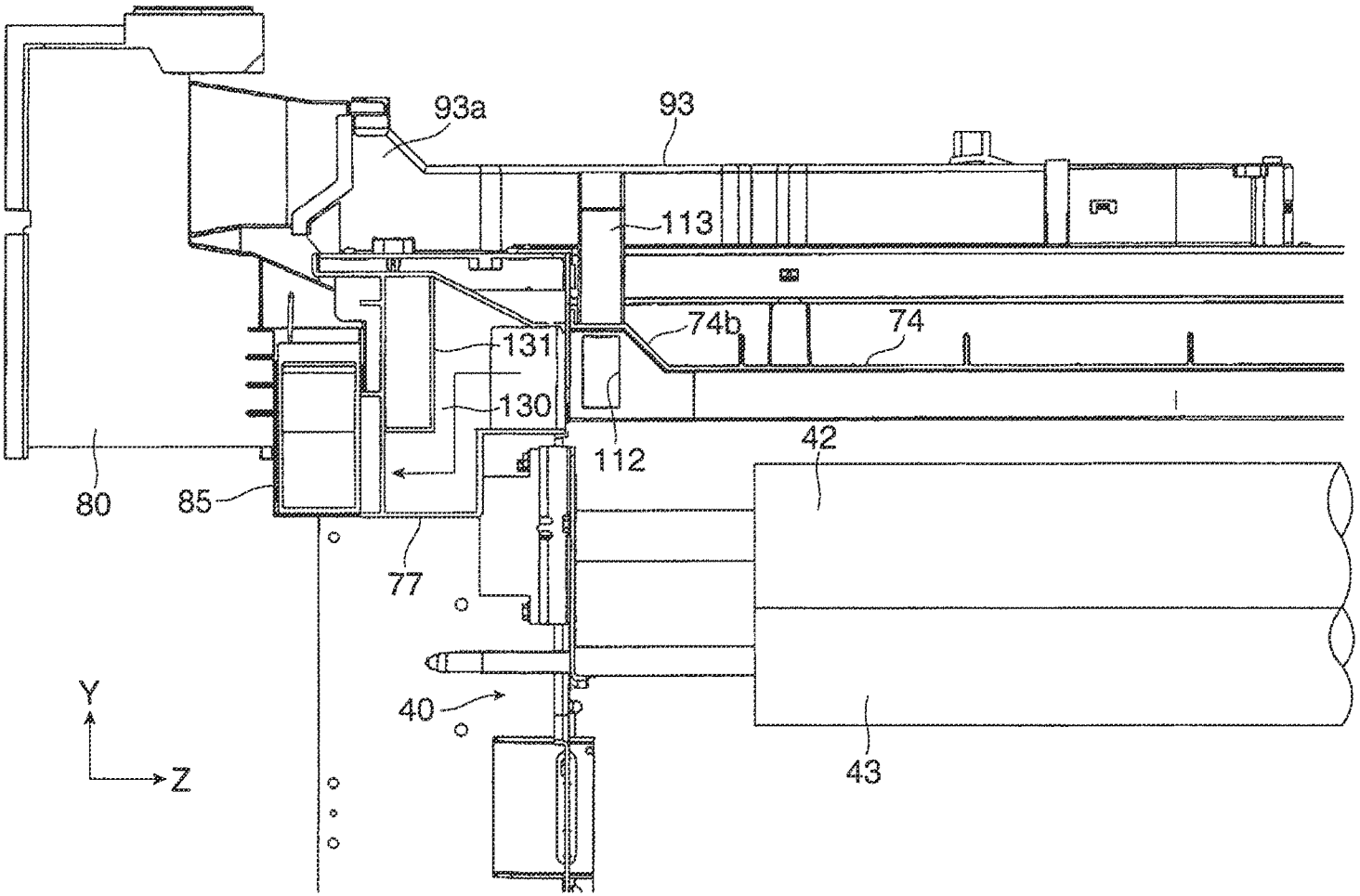
FIG. 14 is a sectional view showing the configuration of an essential part of an image forming apparatus according to a second exemplary embodiment.

FIG. 14 shows an image forming apparatus according to a second exemplary embodiment.

In the image forming apparatus according to the second exemplary embodiment, as shown in FIG. 14, the blown member is a bent portion that is formed by bending part of the flow passage of air that is discharged by the first air discharge fan 76 instead of the shield plate 110 which closes at least part of the flow passage of air that is discharged by the first air discharge fan 76.

The connection portion of the first air discharge duct member 74 and the connection duct 77 is fully opened. The inside space of the connection duct 77 is partitioned by a partition member 131 so as to have a bent portion 130 where the flow passage of air that is discharged by the first air discharge fan 76 is bent.

In the second exemplary embodiment, the blown member can be provided more easily because it can be provided by forming the bent portion 130 inside the connection duct 77.

EXAMPLES

The present inventor produces a trial image forming apparatus 1 as shown in FIG. 1 and evaluates ultrafine particles (UFPs) that are discharged to the outside from it.

The amount of ultrafine particles is evaluated by setting the image forming apparatus 1 in a chamber (test environment chamber) that is highly airtight, causing the image forming apparatus 1 to perform a printing operation continuously for 10 minutes, sucking air existing inside the chamber by a dedicated measuring instrument, and measuring the amount of ultrafine particles contained in air discharged from the image forming apparatus 1.

As a Comparative Example, the amount of ultrafine particles of a conventional image forming apparatus in which the second air discharge fan 87 discharges air to the outside through the side wall of the apparatus main body 1*a* rather than its rear wall is evaluated.

Figure 15:
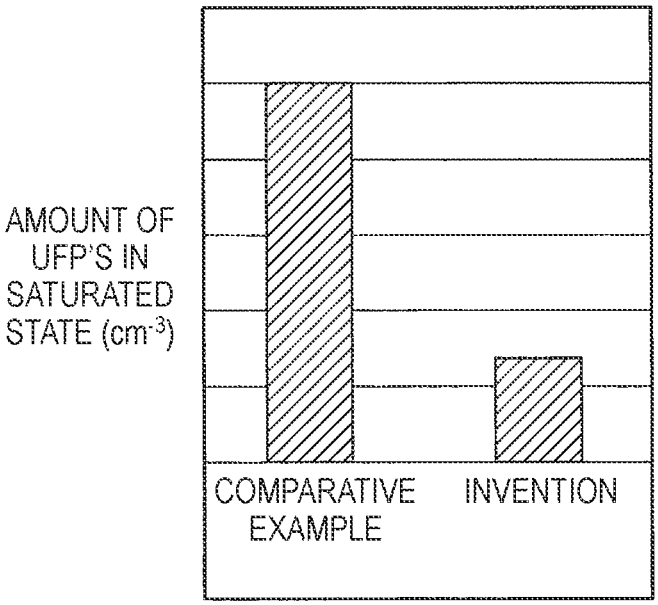
FIG. 15 is a graph showing experimental results.

FIG. 15 is a graph showing results of the evaluation of the amount of ultrafine particles. It is seen from FIG. 15 that in the image forming apparatus 1 according to the first exemplary embodiment the discharge amount of ultrafine particles can be reduced to about ¼ to ½ of that of ultrafine particles discharged from the conventional image forming apparatus.

Although the above exemplary embodiments are directed to the image forming apparatus which form a monochrome image, it goes without saying that the invention can likewise be applied to full-color image forming apparatus which form a toner image of four colors, that is, yellow (Y), magenta (M), cyan (C), and black (K).

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a fixing unit configured to fix an unfixed image held by a recording medium by heating the recording medium;

a first air discharge fan that is disposed at one end in a direction that crosses a recording medium feeding direction of the fixing unit and is configured to discharge air around the fixing unit to an outside;

a second air discharge fan that is disposed on a downstream side of the fixing unit in the recording medium feeding direction and is configured to discharge air from around the downstream side of the fixing unit to the outside;

a first air discharge duct configured to guide the discharge air of the first air discharge fan;

a second air discharge duct configured to guide the discharge air of the second air discharge fan; and a merging duct configured to connect the first air discharge duct and the second air discharge duct, wherein the merging duct is configured such that the discharge air of the first air discharge fan and the discharge air of the second air discharge fan merge together at a position in front of an air discharge opening due to a structure that the first air discharge duct is located below the second air discharge duct, and wherein the merging duct is configured to guide resulting merged air to the air discharge opening of an outside wall of an apparatus main body of the image forming apparatus.

2. The image forming apparatus according to claim 1, wherein the air discharge duct has, in front of the air discharge opening, a filter member configured to remove particular components from discharge air.

3. The image forming apparatus according to claim 1, wherein the air discharge duct has an auxiliary air discharge opening that is formed adjacent to a top wall of the apparatus main body.

4. The image forming apparatus according to claim 2, wherein the air discharge duct has an auxiliary air discharge opening that is formed adjacent to a top wall of the apparatus main body.

5. The image forming apparatus according to claim 1, wherein the first air discharge fan is configured to rotate about a rotational axis that is parallel to a rotational axis of the fixing unit.

6. The image forming apparatus according to claim 1, wherein the direction that crosses the recording medium feeding direction is a horizontal direction, and wherein the end of the image forming apparatus is a peripheral end of the image forming apparatus in the horizontal direction.

7. The image forming apparatus according to claim 1, wherein the first air discharge fan is configured to suck heated air from the downstream side of the fixing unit.

8. The image forming apparatus according to claim 1, wherein the first air discharge fan is configured to suck heated air from above the fixing unit.

9. An image forming apparatus comprising:

a fixing unit configured to fix an unfixed image held by a recording medium by heating the recording medium;

a first air discharge unit that is disposed at one end in a direction that crosses a recording medium feeding direction of the fixing unit and is configured to discharge air around the fixing unit to an outside;

a second air discharge unit that is disposed on a downstream side of the fixing unit in the recording medium feeding direction and is configured to discharge air from around the downstream side of the fixing unit to the outside; and an air discharge duct configured to cause discharge air of the first air discharge unit and discharge air of the second air discharge unit to merge together and to guide resulting merged air to a discharge opening of a rear wall of an apparatus main body of the image forming apparatus, wherein the air discharge duct has an auxiliary air discharge opening that is formed adjacent to a top wall of the apparatus main body.

* * * * *